US008254604B2

(12) United States Patent
Ko

(10) Patent No.: US 8,254,604 B2
(45) Date of Patent: Aug. 28, 2012

(54) ARRAY SPEAKER SYSTEM AND METHOD OF IMPLEMENTING THE SAME

(75) Inventor: Sang-chul Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1263 days.

(21) Appl. No.: 12/007,683

(22) Filed: Jan. 14, 2008

(65) Prior Publication Data

US 2009/0087000 A1 Apr. 2, 2009

(30) Foreign Application Priority Data

Oct. 1, 2007 (KR) ..... 10-2007-0098891

(51) Int. Cl.
*H04R 5/00* (2006.01)
*H04R 5/02* (2006.01)
*H04R 25/00* (2006.01)

(52) U.S. Cl. ..... 381/300; 381/18; 381/19; 381/160; 381/182; 381/307

(58) Field of Classification Search ..... 381/300, 381/182, 307
See application file for complete search history.

(56) References Cited

U.S. PATENT DOCUMENTS 6,967,541 B2 * 11/2005 Hooley ..... 332/109
7,215,788 B2 * 5/2007 Hooley ..... 381/120
7,889,878 B2 * 2/2011 Takumai ..... 381/303
7,920,710 B2 * 4/2011 Konagai et al. ..... 381/111
2004/0151325 A1 * 8/2004 Hooley et al. ..... 381/18
2006/0165242 A1 * 7/2006 Miki et al. ..... 381/59
2007/0110268 A1 * 5/2007 Konagai et al. ..... 381/335
2008/0101631 A1 * 5/2008 Jung et al. ..... 381/307
2008/0212805 A1 * 9/2008 Fincham ..... 381/160
2009/0141915 A1 * 6/2009 Ko et al. ..... 381/182
2009/0262962 A1 * 10/2009 Iwasaki ..... 381/300

* cited by examiner

*Primary Examiner* — David Warren
*Assistant Examiner* — Christina Russell
(74) *Attorney, Agent, or Firm* — Staas & Halsey LLP

(57) ABSTRACT

Provided are an array speaker system and a method of implementing the same. The array speaker system includes a group setting unit setting one or more combinations of a plurality of speakers included in an array speaker system into at least one group according to a predetermined adjustment factor, a signal assignment unit dividing an input signal into at least one sound source signal according to the adjustment factor and selectively assigning the divided sound source signal(s) to the set group(s), a sound adjustment unit adjusting a sound source signal to be output through speakers within the group according to sound source characteristics of the group, and a signal output unit outputting the adjusted sound source signal through the speakers within the group. Using the array speaker system, sound adjustment and sound output optimized for each frequency band can be obtained during output of a sound source signal having a broad range of frequencies, and a near-field effect that distorts an output sound source signal can be prevented. Moreover, stereo and multi-channel effects can be obtained and the directivity of the array speaker system can be improved.

13 Claims, 11 Drawing Sheets
(2 of 11 Drawing Sheet(s) Filed in Color)

ARRAY SPEAKER SYSTEM AND METHOD OF IMPLEMENTING THE SAME

CROSS-REFERENCE TO RELATED PATENT APPLICATION

This application claims the benefit of Korean Patent Application No. 10-2007-0098891, filed on Oct. 1, 2007, in the Korean Intellectual Property Office, the disclosure of which is incorporated herein in its entirety by reference.

BACKGROUND OF THE INVENTION

1. Field of the Invention

The present invention relates to an array speaker system including a plurality of speakers and a method of implementing the same, and more particularly, to an array speaker system for adjusting a sound source signal that is output from an array speaker, for example, adjusting directivity characteristics of the sound source signal, such as an emission direction and a target emission position of the sound source signal, and the number of focusing positions of the sound source signal, and a method of implementing the array speaker system.

2. Description of the Related Art

An array speaker system is composed of a plurality of speakers that can adjust the direction of reproduced sound or emit sound towards a particular area. To direct sound to a target position or in a target direction, an array speaker system and a plurality of sound source signals are required. The principle of sound transmission, generally called directivity, is to make a plurality of sound source signals overlap each other using phase differences between the sound source signals in order to increase signal strength along a specific direction, thereby transmitting the sound source signals in the specific direction. Thus, such directivity can be implemented by disposing a plurality of speakers in particular positions and adjusting the sound source signals of the array, which are output through the speakers.

As various portable digital devices have come into common use, the need for speakers capable of reproducing sound signals has increased. Along with this trend, users' expectation levels and demands with respect to a sound reproduction function implemented in a portable digital device also gradually increase. For example, users demand speakers with increasingly sophisticated technology that have evolved from conventional mono speakers to stereo speakers and further to multi-channel array speaker systems. However, portable digital devices place physical restrictions on the size of an array speaker system, in that a small size is required, on the weight of the array speaker system, in that a light weight is required, or on the number of sound sources, i.e., speakers of the array speaker system. As a result, because of such physical hardware restrictions, the sound adjustment performance of a small-size digital device may degrade in a particular direction or area at certain frequencies of output sound source signals.

SUMMARY OF THE INVENTION

The present invention provides an array speaker system and a method of implementing the same whereby a difficulty in sound adjustment during the output of a sound source signal having broad range of frequencies, caused by fixed intervals between speakers of an array speaker system, can be overcome, the occurrence of a near-field effect that distorts output sound source signals during a listener's approach to the array speaker system can be prevented, and degradation in the sound adjustment performance of a small-size audio device can be solved.

According to one aspect of the present invention, there is provided an array speaker system including a group setting unit, a signal assignment unit, a sound adjustment unit, and a signal output unit. The group setting unit sets combinations of a plurality of speakers included in an array speaker system into groups according to a predetermined adjustment factor. The signal assignment unit divides an input signal into at least one sound source signal according to the adjustment factor and selectively assigns the divided sound source signal(s) to the set group(s). The sound adjustment unit adjusts a sound source signal to be output through speakers within the group according to sound source characteristics of the group. The signal output unit outputs the adjusted sound source signal through the speakers within the group.

According to another aspect of the present invention, there is provided a method of implementing an array speaker system. The method includes setting combinations of a plurality of speakers included in an array speaker system as groups according to a predetermined adjustment factor, dividing an input signal into at least one sound source signal according to the adjustment factor and selectively assigning the divided sound source signal(s) to the set group(s), adjusting a sound source signal to be output through speakers within the appropriate group according to sound source characteristics of the group, and outputting the adjusted sound source signal through the speakers within the group.

According to another aspect of the present invention, there is provided a computer-readable recording medium having recorded thereon a program for executing a method of implementing the array speaker system. The method includes setting combinations of a plurality of speakers included in an array speaker system as groups according to a predetermined adjustment factor, dividing an input signal into at least one sound source signal according to the adjustment factor and selectively assigning the divided sound source signal(s) to the set group(s), adjusting a sound source signal to be output through speakers within the appropriate group according to sound source characteristics of the group, and outputting the adjusted sound source signal through the speakers within the group.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The above and other features and advantages of the present invention will become more apparent by describing in detail exemplary embodiments thereof with reference to the attached drawings in which.

DETAILED DESCRIPTION OF THE INVENTION

Figure 1:
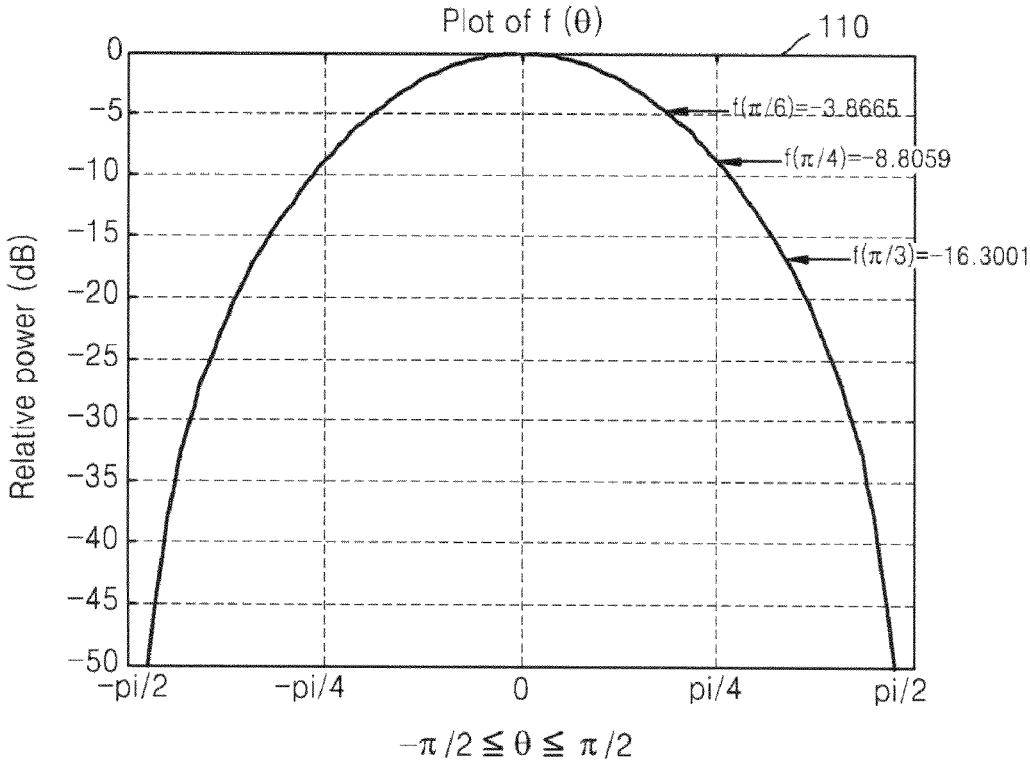
FIG. 1 illustrates beam patterns of an array speaker system with respect to frequency bands.
Figure 1:
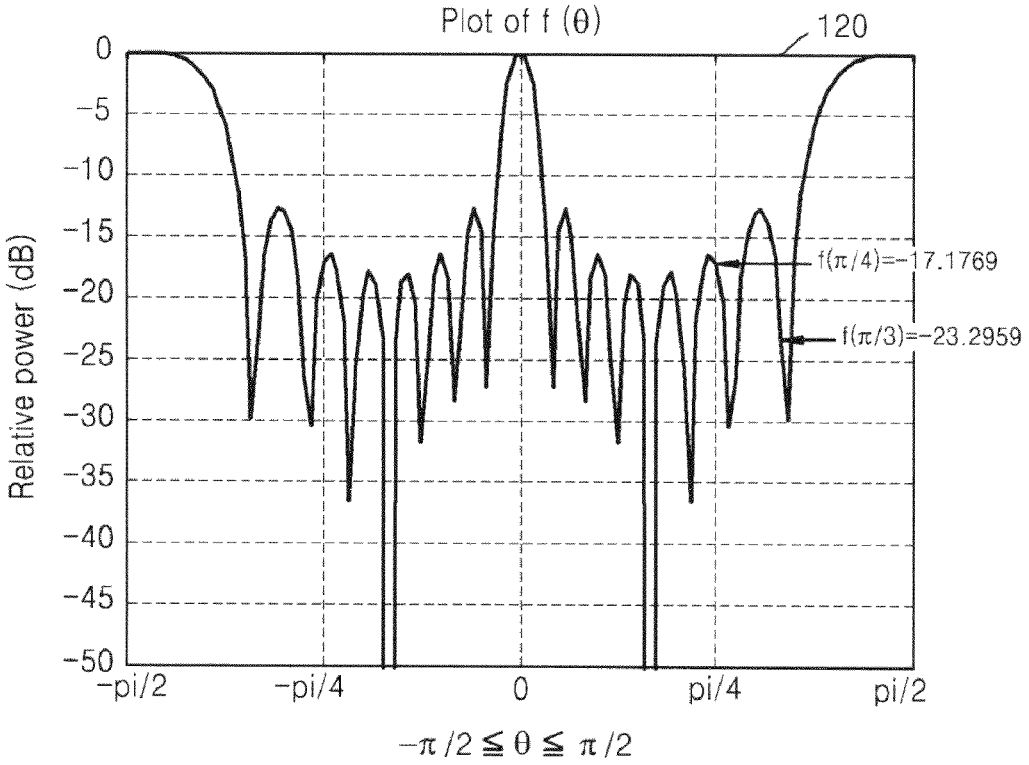

Hereinafter, exemplary embodiments of the present invention will be described in detail with reference to the accompanying drawings. It should be noted that like reference numerals refer to like elements illustrated in one or more of the drawings. In the following description of the present invention, detailed descriptions of known functions and configurations incorporated herein will be omitted for conciseness and clarity.

FIG. 1 illustrates beam patterns of an array speaker system with respect to frequency bands, in which the beam patterns show low-frequency and high-frequency directivity characteristics. A beam pattern means a graph of measurements of electric field strengths of electromagnetic waves emitted in all directions from 0° to 360° from signal output devices such as a speaker and an antenna. The beam pattern is obtained by receiving signals from all directions, between 0° and 360°, from a speaker, where the signals output from the speaker are received by and subject to measurement using a measurement device, which measures the received electric field strengths at each measurement angle, and the measurements are expressed in a waveform on a polar chart. By referring to FIG. 1 it is seen that electric field strength increases at coordinates further from the center of the polar chart, which means that there is directivity along a corresponding direction.

In FIG. 1, a beam pattern 110 corresponds to a low frequency and a beam pattern 120 corresponds to a high frequency. When an array speaker system is used, it is a general feature that the effect of sound adjustment changes according to frequency. Thus, in the case of a low frequency, if a wavelength is greater than the size of an array speaker system, it is difficult to focus sound to a particular position because of the beam width increase. On the other hand, in the case of a high frequency, the beam width decreases or unnecessary side robes occur. Side robes mean an emission pattern that is non-uniformly generated in within a beam pattern of the array speaker system. In the beam pattern 120 illustrated in FIG. 1, the side robes are generated in the form of a non-uniform beam pattern having a plurality of small, thin peaks at both sides of the central beam. The above-described problems often occur in small-size audio devices because sound adjustment is not easy to perform in a small-size array.

Figure 2:
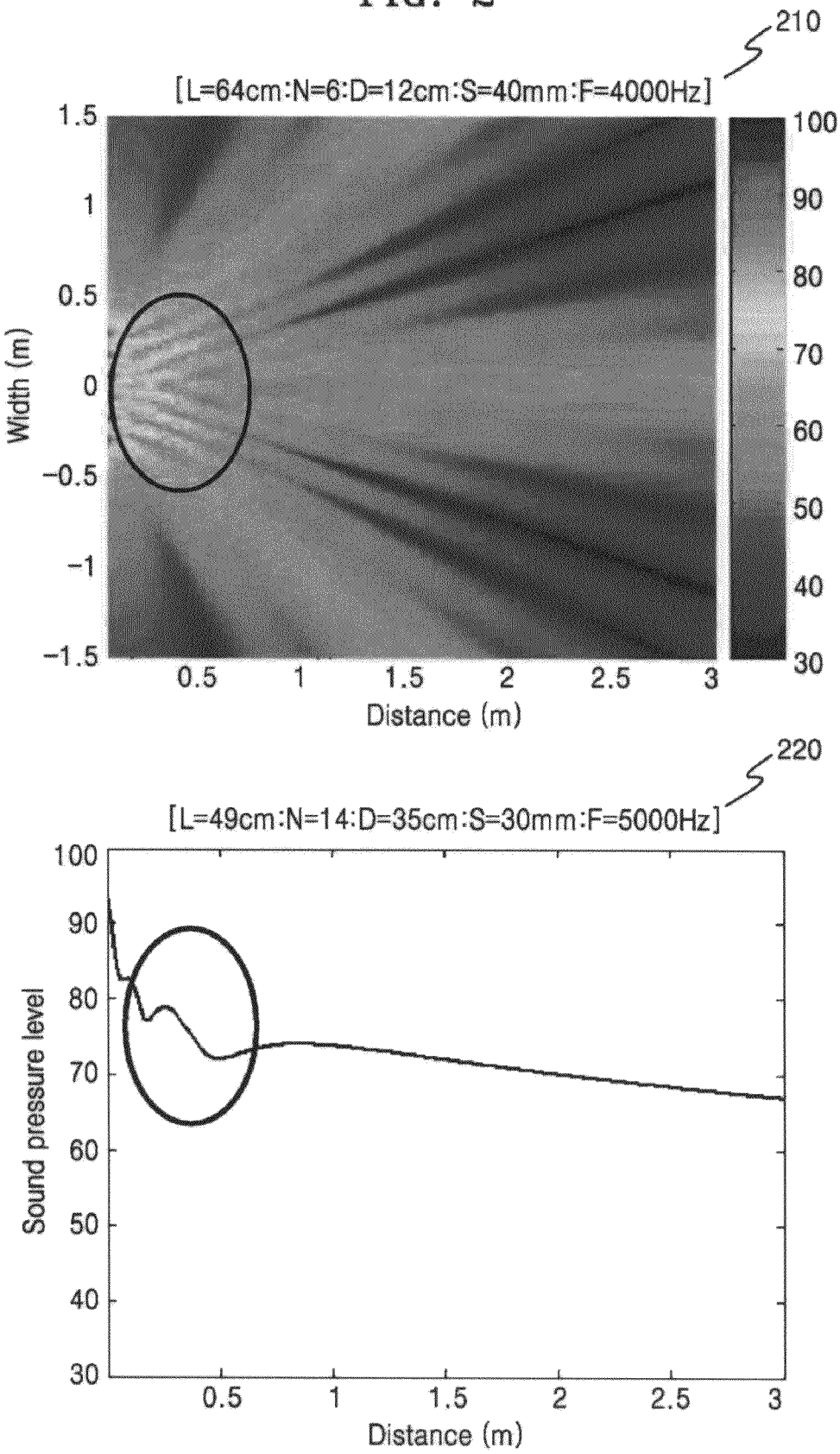
FIG. 2 illustrates an example of a near-field effect that occurs using an array speaker system.

FIG. 2 illustrates an example of a near-field effect that occurs using an array speaker system. The near-field effect means sound distortion near an array speaker system. In FIG. 2, an emission pattern 210 shows how the emission characteristics of a sound source signal change with distance from the array speaker system. In the emission pattern 210, sound distortion occurs due to mutual interference between a plurality of output sound source signals in a portion indicated by a circle, i.e., a spot within 0.5 m from the array speaker system. In FIG. 2, a graph 220 shows how the sound pressure level changes with distance from the array speaker system. It can be seen in the graph 220 that the sound pressure level is irregularly distorted in a portion indicated by a circle. In other words, a listener experiences difficulty in listening to a sound source signal within a particular distance in which the output sound source signal is likely to be distorted.

In particular, unlike in audio devices that are used commonly in homes, in a small-size audio device such as a cellular phone, a Digital Multimedia Broadcasting (DMB) player, or a Portable Multimedia Player (PMP) that allows a user to view moving pictures while being carried, the possibility of the near-field effect occurring increases due to the likelihood of there being a short distance between the user and the audio device. Therefore, there is a need for an array speaker system capable of correctly outputting a sound source signal while suppressing the occurrence of the near-field effect even if a short distance exists between an array speaker system and a user.

Figure 3:
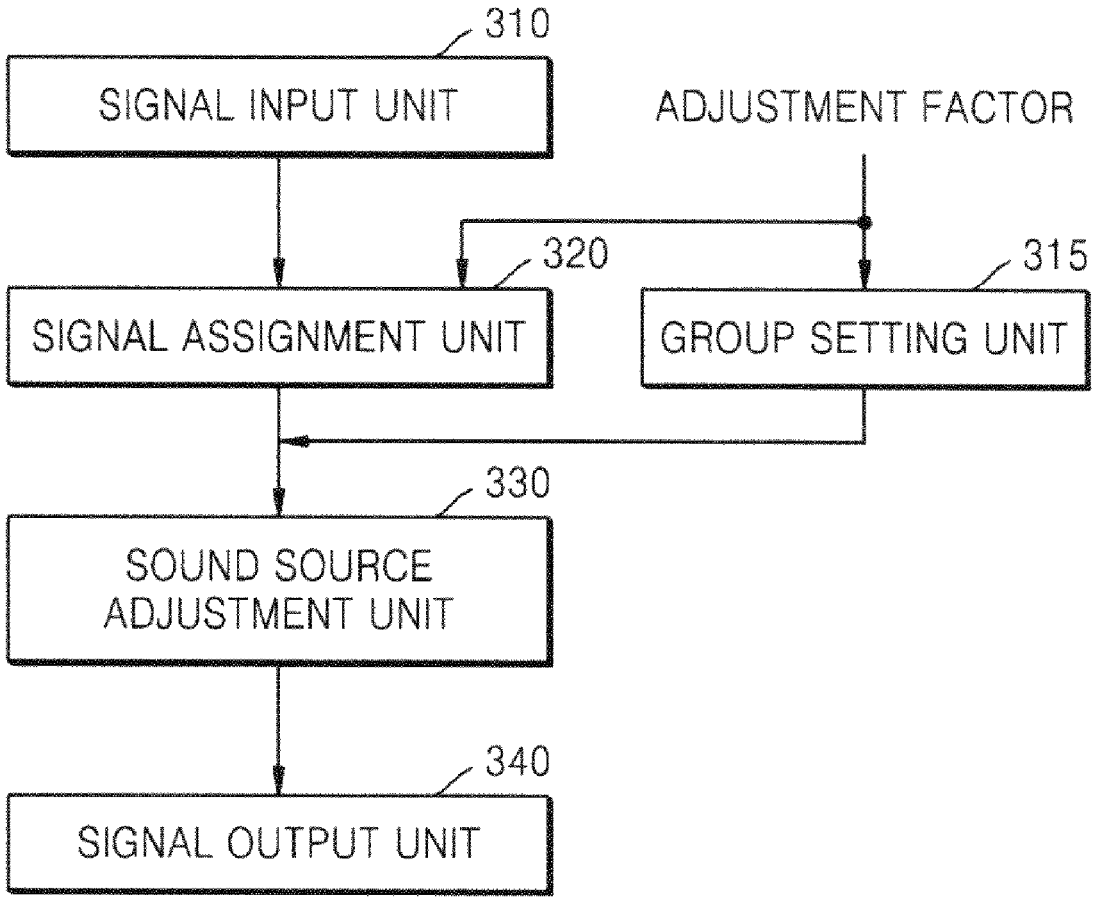
FIG. 3 is a block diagram of an array speaker system according to an exemplary embodiment of the present invention.

FIG. 3 is a block diagram of an array speaker system according to an exemplary embodiment of the present invention. Referring to FIG. 3, the array speaker system includes a signal input unit 310, a signal assignment unit 320, a sound source adjustment unit 330, a signal output unit 340, and a group setting unit 315.

The signal input unit 310 receives a sound source signal to be output from an array speaker system. The sound source signal may be a multi-channel signal including a mono signal or a stereo signal.

The group setting unit 315 sets each of the logical combinations of a plurality of speakers included in the array speaker system as a group according to a specific adjustment factor. The specific adjustment factor means a value that is preset based on factors for determining the directivity of a sound source signal or based on the sound field characteristics of the sound source signal such as the frequency band, the emission direction, the focusing position, and the number of focusing positions of the sound source signal. The adjustment factor is a value that is set in advance by previously calculating logical combinations of speakers using hardware information regarding the array speaker system, such as the size of the array speaker system, the number of speakers included in the array speaker system, and the sound pressure characteristics of the speakers, so as to suit a sound source signal to be output through the array speaker system. Thus, the set value, i.e., the preset specific adjustment factor, may be stored in a particular storage device and may be called upon when a user desires to change the sound field of the array speaker system, or the set value may be input directly by the user or input from an automated audio system. In other words, the group setting unit 315 reorganizes the logical combinations of the speakers of the array speaker system such that the array speaker system receives the set value for adjusting the sound source signal to adjust the sound source signal to sound adjustment characteristics such as a direction and position of the sound source signal desired by the user and outputs the sound source signal through the array speaker system.

The logical combinations of the speakers of the array speaker system will now be described in more detail. In a general array speaker system, fixed-size speakers are fixed with respect to position to constitute the array speaker system. In other words, the speakers of the array speaker system are physically fixed. As a result, it is not easy for the array speaker system to perform sound adjustment by overcoming hardware restrictions. On the other hand, the group setting unit 315 according to the current embodiment of the present invention sets at least one logical group for physically fixed speakers. For example, when the array speaker system includes 10 speakers, 5 of the 10 speakers may be set as a group 1 and the remaining 5 speakers may be set as a group 2. By assigning left/right signals separately to the 2 groups, stereo sound can be implemented with the single array speaker system. Similarly, when the user desires to perform different signal processing on a sound source signal at different frequencies, a group may be set for each frequency band and the different frequency bands of the sound source signal may be assigned to the appropriate group, thereby dynamically utilizing the fixed speakers of the array speaker system. In this way, it is possible to obtain the same effect as when at least 2 array speaker systems exist, by using the speakers which have been grouped into logical combinations.

The signal assignment unit 320 divides an input sound source signal into at least one sound source signal according to the adjustment factor and selectively assigns the sound source signal(s) to the at least one logical group set by the group setting unit 315. More specifically, the signal assignment unit 320 first copies the sound source signal input from the signal input unit 310 a number of times equal to the number of channels required for an output operation. The signal assignment unit 320 then divides the copied input sound source signals into at least one sound source signal according to the adjustment factor. A criterion for dividing the sound source signal may change according to the adjustment factor, and the number of divided sound source signals may be the same as the number of groups set by the group setting unit 315. The signal assignment unit 320 assigns the divided sound source signals to corresponding groups. The assignment of the sound source signals to the groups means assignment of the sound source signals to speakers within the groups set by the group setting unit 315. The selective assignment of the sound source signals means that the divided sound source signals may or may not be assigned to corresponding groups according to the adjustment factor. For example, when the input sound source signal is divided into left/right sound source signals, the right sound source signal must not be assigned to a group set for a combination of speakers that tend to output the left sound source signal.

The division of the input sound source signal and assignment of the divided sound source signals to the set groups may be implemented by supplying the sound source signal to each of the connected speakers or blocking the sound source signal using hardware such as a multiplexer or using an algorithm such as a window function based on information about the set groups. For example, if a criterion for dividing the sound source signal is a frequency band, the signal assignment unit 320 may copy the sound source signal input through the signal input unit 310 a number of times equal to the number of required channels, divide the copied sound source signals into at least one frequency band using a filter suitable for each frequency band, and then assign the divided sound source signals to the appropriate groups set for the individual frequency bands.

The sound source adjustment unit 330 adjusts the sound source signals input from the signal assignment unit 320 according to the sound source characteristics of the groups set by the group setting unit 315. More specifically, the sound source adjustment unit 330 adjusts the sound source signals input from the signal assignment unit 320 by performing various types of signal processing, such as the application of a gain for signal amplification, a delay for signal delay by a predetermined amount of time, and a Finite Impulse Response (FIR) filter, on the sound source signals according to the sound source characteristics of the group. Gain, delay, and filter values are calculated as values for forming a particular sound field, and the values may vary depending on desired properties of the sound field such as the target emission direction and beam width of the sound source signals. For example, when the group setting unit 315 sets 2 groups and the 2 groups tend to focus the sound source signals in different directions, the sound source adjustment unit 330 may calculate delay values with respect to speakers included in the 2 groups in order to adjust the directivities of the sound source signals from the speakers included in each of the groups and may delay the sound source signals supplied to the speakers by the calculated delay values.

The speakers of the array speaker system may function as the signal output unit 340 and output the sound source signals adjusted by the sound source adjustment unit 330. While the speakers of the array speaker system are taken as an example of the signal output unit 340 in the current embodiment of the present invention for convenience of description, the signal output unit 340 may be any sound source signal output means capable of outputting sound waves.

In the following description, processing performed by the sound source adjustment unit 330 with respect to the groups set by the group setting unit 315 will be described in more detail.

Figure 4:
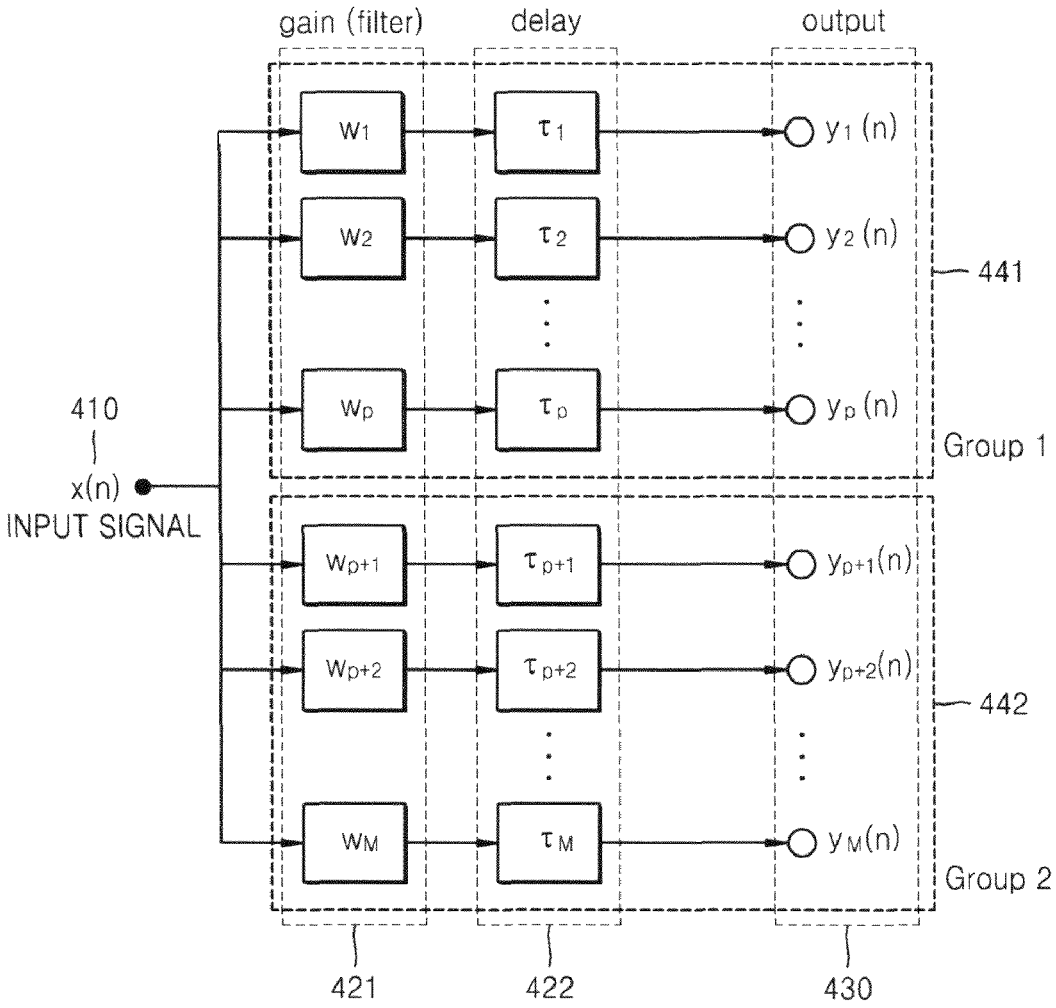
FIG. 4 is a detailed block diagram of a sound source signal adjustment unit of an array speaker system according to an exemplary embodiment of the present invention.

FIG. 4 is a detailed block diagram of the sound source adjustment unit 330 of the array speaker system according to an exemplary embodiment of the present invention, in which only an input signal 410 input through the signal input unit 310, the sound source adjustment unit 330, and output signals 430 are illustrated. In the current embodiment of the present invention, it is assumed that 2 groups are set for speakers that output sound source signals divided from the input signal 410.

Referring to FIG. 4, the input signal x(n) 410 is assigned to a group #1 441 and a group #2 442 that are set by a group setting unit (not shown) for sound source adjustment. In order to separately assign the input signal x(n) 410 to the groups 441 and 442, a signal assignment unit (320 of FIG. 3) is required, but is not shown for convenience in the current embodiment of the present invention. In FIG. 4, the groups 441 and 442 are composed of P sound source signals and (M-P) sound source signals, respectively, where M is the total number of sound source signals, and are logically set to include speakers $y_1(n), y_2(n), \ldots, y_P(n)$ and speakers $y_{P+1}(n)$, $y_{P+2}(n), \ldots, y_M(n)$, respectively, which output the sound source signals. The sound source signals may be simple copies of the input signal x(n) 410 according to the characteristics of sound source signals to be output from the array speaker system or may be divided according to frequency bands such that one output signal corresponds to one frequency band. Each of the sound source signals is subject to sound source adjustment by passing through gains 421 or filters and delays 422. Such sound source adjustment is controlled by adjustment factors input to the group setting unit (not shown). As discussed previously, the adjustment factors mean preset values for controlling a direction or a beam width according to the requirements of the user. The adjusted sound source signals are transmitted to speakers included in each group in order to be output.

The following description provides various embodiments of a method for sound source adjustment in which logical groups of physically fixed hardware speakers are set.

In general, it is known that the optimal interval between speakers in an array speaker system for adjusting a sound source signal to travel in a user desired direction is half the wavelength of the sound source signal. The term "optimal" means that the directivity characteristics of a sound source signal emitted from the array speaker system are best. Thus, by recognizing the characteristics of a sound source signal that is to be output from the array speaker system, calculating half of the wavelength of the sound source signal and adjusting each interval between speakers of the array speaker system to the calculated length, an array speaker system having optimal performance can be implemented. Since a sound source signal output through the array speaker system is transmitted in the form of a sound waveform, it is bound by the velocity of sound that is a sound transmission speed. Thus, frequency and wavelength are in inversely proportional to each other at a constant sound velocity. For example, if frequency decreases and a low-frequency signal is output, wavelength increases, and the optimal interval between speakers increases. In other words, when the array speaker system is constructed, each interval between speakers has to be large. On the other hand, to output a high-frequency signal, the optimal emission characteristics can be obtained using small intervals between the speakers.

However, in a general array speaker system, intervals between speakers are fixed and the wavelength of a sound source signal to be output is not constant at all times. For these reasons, it is practically impossible to dispose the speakers so as to maintain an interval that is half the wavelength of the sound source signal for all frequencies. Therefore, in the current embodiment of the present invention, intervals between speakers used for output are changed by using only some of the fixed speakers of the array speaker system in order to overcome limitations associated with physically fixed intervals between the speakers. In other words, a combination of speakers spaced apart by particular intervals out of speakers disposed at fixed intervals in an array speaker system is set as a group and sound source signals of a corresponding frequency are output through the set group, thereby optimizing emission characteristics for an input sound source signal having a broadband frequency.

Figure 5A:
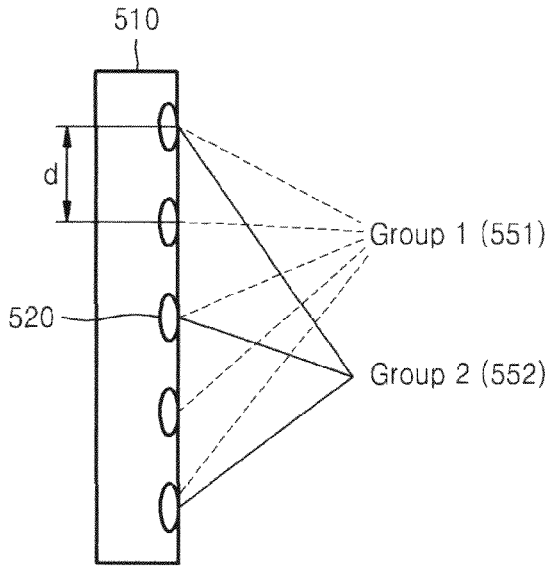
FIGS. 5A and 5B are diagrams for explaining the setting of groups in consideration of intervals between speakers according to another exemplary embodiment of the present invention.
Figure 5B:
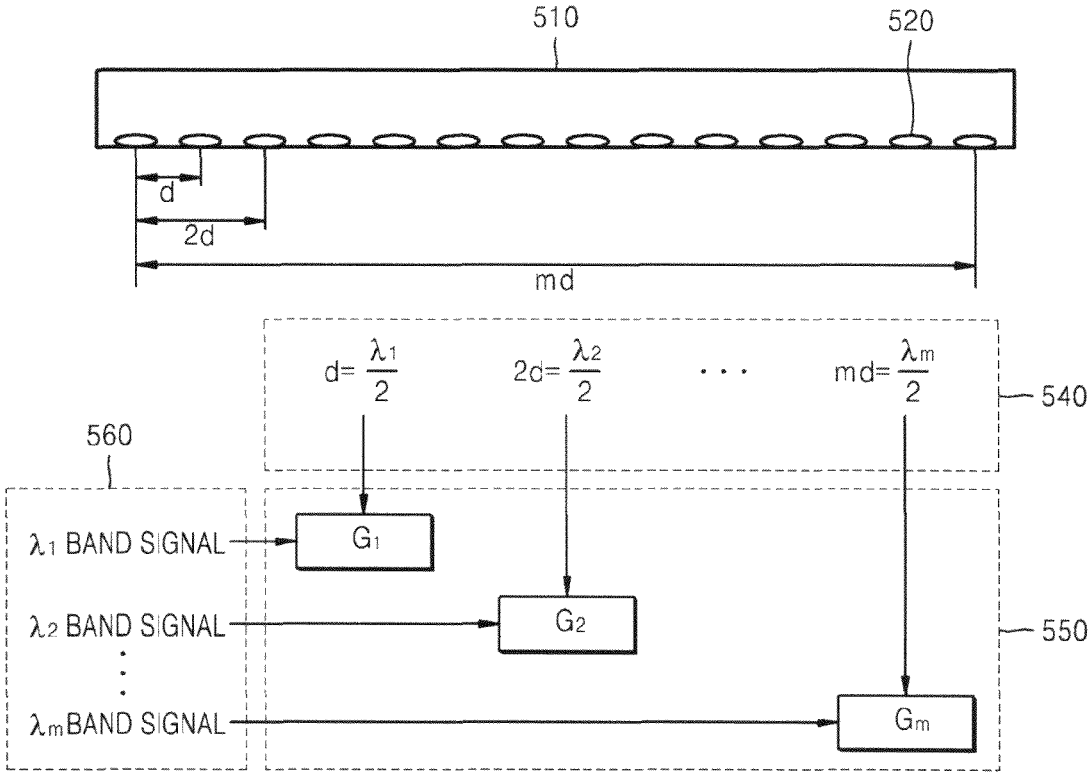

FIGS. 5A and 5B are diagrams for explaining the setting of groups in consideration of intervals between speakers according to another exemplary embodiment of the present invention.

In FIG. 5A, it is assumed that speakers 520 of an array speaker system 510 are disposed at positions separated by constant intervals of length d. A group #1 551 includes speakers spaced by intervals d and a group #2 552 includes every other speaker, spaced by intervals of length 2*d*. The group #1 551 is more suitable for a high-frequency signal than the group #2 552 and the group #2 552 is more suitable for a low-frequency signal than the group #1 551. As such, logical groups of speakers of an array speaker system are set with each group having particular intervals according to the characteristics of an input sound source signal and only speakers within the suitable set group are used to output the sound source signal, thereby overcoming a physical limitation of the array speaker system having fixed speaker intervals and facilitating sound adjustment.

FIG. 5B generalizes the group setting procedure illustrated in FIG. 5A. Like in FIG. 5A, in FIG. 5B, speakers 520 of an array speaker system 510 have constant intervals of length d therebetween. When input signals 560 are broadband signals having various wavelengths and an adjustment factor is a set value according to the frequency bands of a sound source signal, a group setting unit (not shown) allocates speakers 520 into logical groups $G_1, G_2, \ldots, G_m$ such that each interval between the speakers of the array speaker system 510 in a particular group is half of the wavelength corresponding to a particular frequency band of the sound source signal. In other words, as the sound source signal frequency goes from a high frequency to a low frequency the intervals separating speakers within the groups increase. In FIG. 5B, equations 540 for organizing speakers into groups, such that each interval between the speakers of a group is half of the wavelength corresponding to a particular frequency band of the sound source signal, are shown and groups 550 corresponding to the calculated equations are shown. The signal assignment unit (not shown) divides the input signals 560 according to frequency bands and assigns the input signals 560 to the groups 550 $G_1, G_2, \ldots, G_m$. Even when the input signals 560 have different wavelengths, the optimal interval between speakers is calculated for each of the input signals 560 and speakers spaced by the calculated optimal interval are set as a logical group, thereby optimizing emission characteristics in a broadband signal.

Figure 6A:
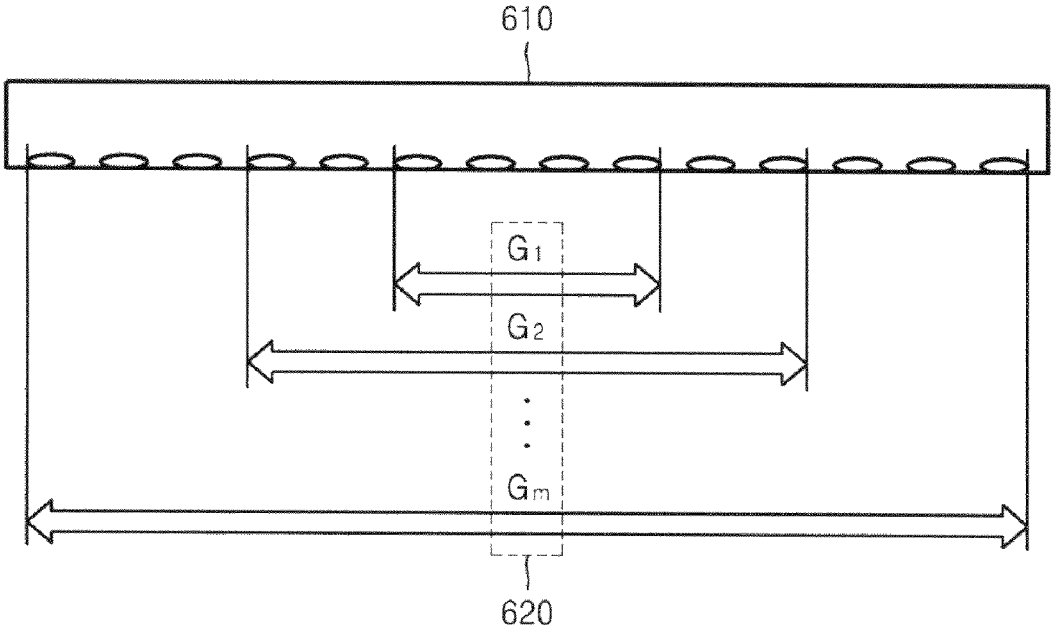
FIGS. 6A and 6B are diagrams for explaining the setting of groups in consideration of intervals between speakers according to still another exemplary embodiment of the present invention.
Figure 6B:
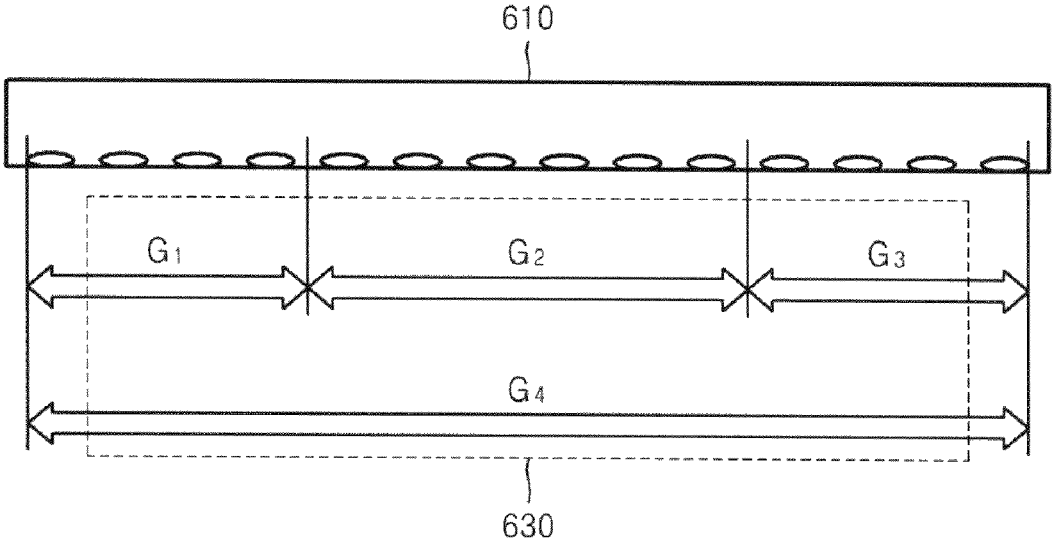

FIGS. 6A and 6B are diagrams for explaining the setting of groups in consideration of positions of speakers according to still another exemplary embodiment of the present invention.

As mentioned above, in a small-sized audio device, the near-field effect that distorts sound during a user's approach to the array speaker system is likely to occur due to the high likelihood of there being a short distance between the audio device and the user. In particular, the near-field effect is affected by the frequency of a sound source signal and the size of the array speaker system. It is generally known that area and distance where the near-field effect occurs decrease as the size of the array speaker system decreases. However, it is difficult to remove the near-field effect occurring in a general array speaker system because the physical size of the array speaker system is fixed. Thus, in the current embodiment of the present invention, the near-field effect will be suppressed by adjusting the frequencies of sound source signals to be output and the size of the array speaker system. In an array speaker system having fixed speaker intervals and a fixed size, the size of the array speaker system can be virtually reduced by not using some of speakers of the array speaker system. For example, in the case of a high frequency sound source signal, the near-field effect is reduced as the size of the array speaker system that outputs a sound source signal is reduced. Thus, the size of the array speaker system can be reduced by using only speakers in a center portion of the array speaker system without using speakers in an outmost portion of the array speaker system.

In FIG. 6A, $G_1, G_2, \ldots, G_m$ are logical groups 620 that are set according to the required size an array speaker system 610. When sound source signals to be output are input separately for each frequency, the group $G_1$ corresponding to a small array speaker system size may be mapped to sound source signals with a high frequency and the group $G_m$ corresponding to a large array speaker system size may be mapped to sound source signals with a low frequency. In FIG. 6B, groups 630 such as a group $G_2$ including speakers in the center portion of the array speaker system 610, groups $G_1$ and $G_3$ including speakers in the outmost portion of the array speaker system 610, and a group $G_4$ including all speakers of the array speaker system 610, may be set. This group setting method based on frequency bands may be previously obtained according to the characteristics of sound source signals and the characteristics of physical hardware speakers and may be stored and later extracted for application when a group setting unit (not shown) sets speakers of an array speaker system as groups.

Figure 7:
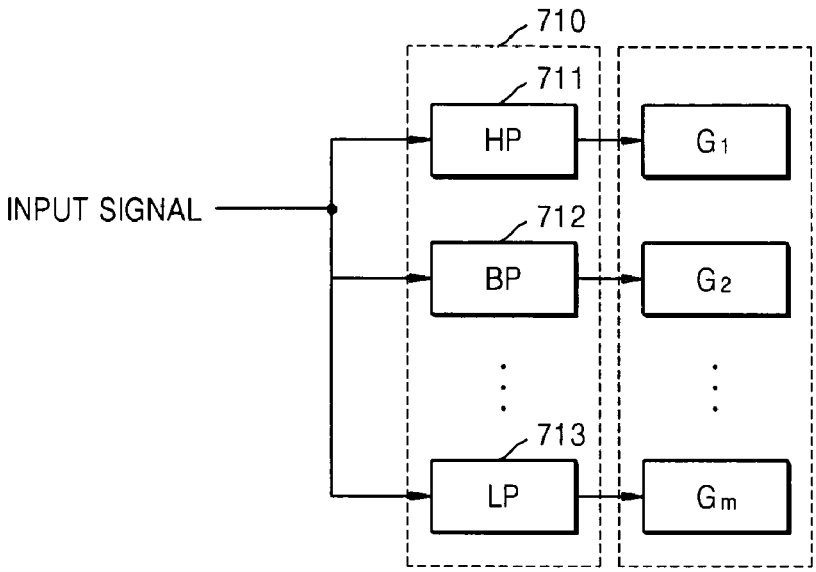
FIG. 7 is a block diagram of a structure for connecting sound source signals, divided according to frequency bands, with speakers of an array speaker system according to still another exemplary embodiment of the present invention.

FIG. 7 is a block diagram of a structure for connecting sound source signals, divided according to frequency bands, with speakers of an array speaker system according to still another exemplary embodiment of the present invention, in which a method of connecting input signals with set groups is shown. In the current embodiment of the present invention, it is assumed that input signals are processed separately for each frequency band as in FIG. 5B. In FIG. 7, an input signal 710 is copied by a signal assignment unit (not shown) as many times as required and the copies are input into a high pass filter 711, a band pass filter 712, and a low pass filter 713 in order to divide the input signal 710 into signals of corresponding frequency bands by each of the high pass filter 711, the band pass filter 712, and the low pass filter 713. The divided signals are assigned to groups $G_1, G_2, \ldots, G_n$ set by a group setting unit (not shown) according to an adjustment factor.

Figure 8:
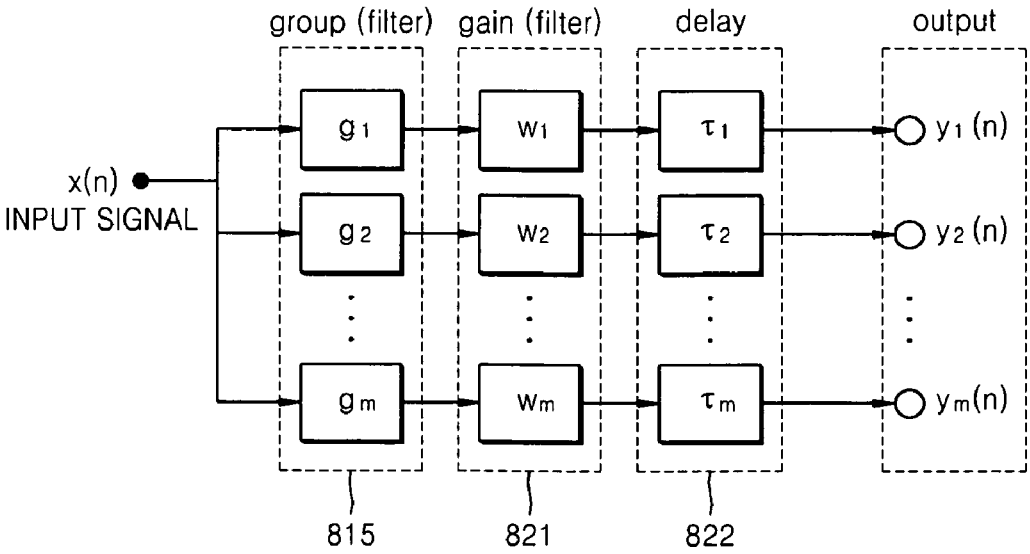
FIG. 8 is a block diagram for explaining the setting of groups using a filter according to still another exemplary embodiment of the present invention.

Group setting may also be performed using a filter, instead of using the positions of speakers of an array speaker system or the size of an array speak system. FIG. 8 is a block diagram for explaining the setting of groups using a filter according to still another exemplary embodiment of the present invention. In FIG. 8, an input signal x(n) is automatically divided into groups by applying a previously calculated group filter 815 for the input signal x(n). Gains 821 and delays 822 are applied to the divided input signals according to requirements of the groups, thereby performing desired sound adjustment. The group filter 815 is not intended for sound source adjustment like the gains 821 or the delays 822. Instead, the group filter 815 is intended to perform a similar function to a group setting unit (not shown). That is, sound source signals are not divided physically, but are divided using an algorithm such as a window form, or using a frequency filter. As a result, the sound source signals are selectively divided after passing through the group filter 815 and the divided sound source signals form different groups having different characteristics. In the following description, various embodiments for dividing sound source signals into groups using the group filter and outputting the groups will be described.

Figure 9A:
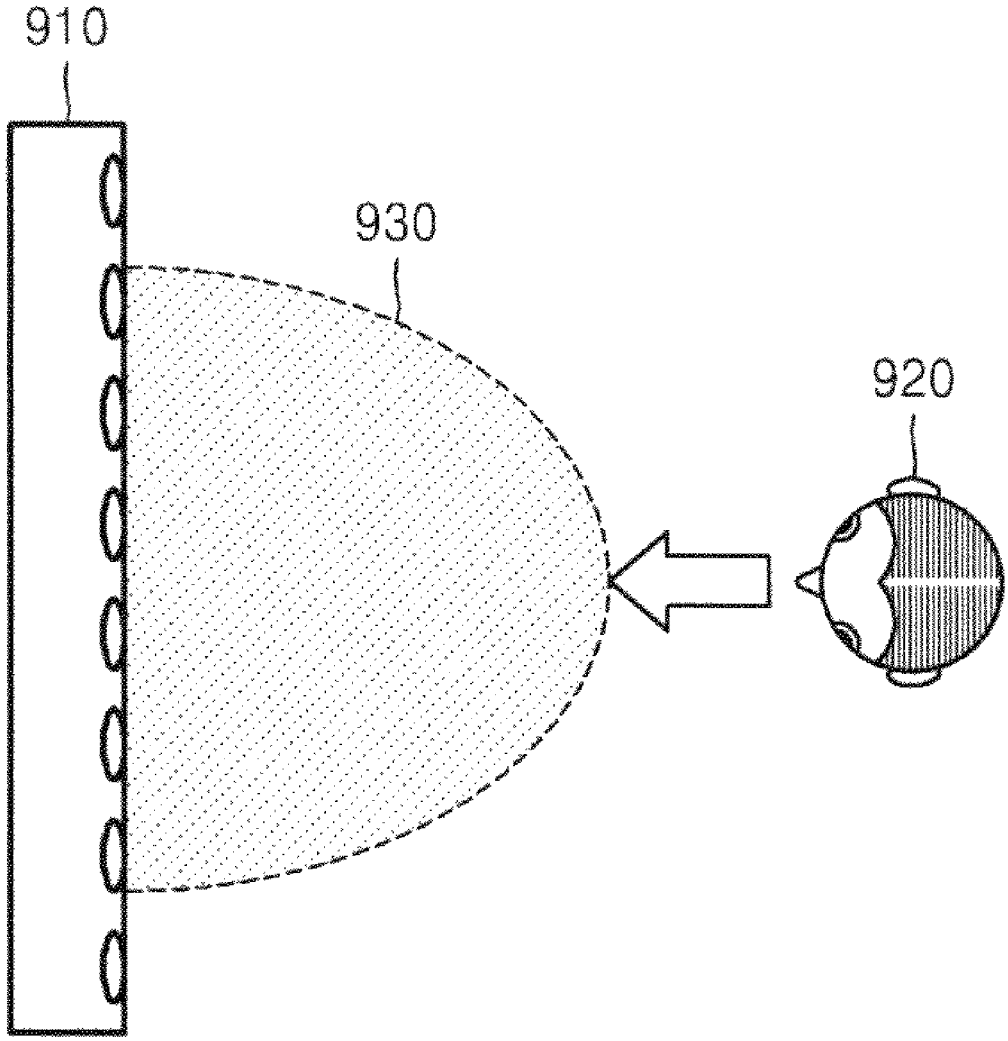
FIGS. 9A and 9B are diagrams for explaining the setting of groups using a filter corresponding to the size of an array speaker system and an experimental example according to still another exemplary embodiment of the present invention.
Figure 9B:
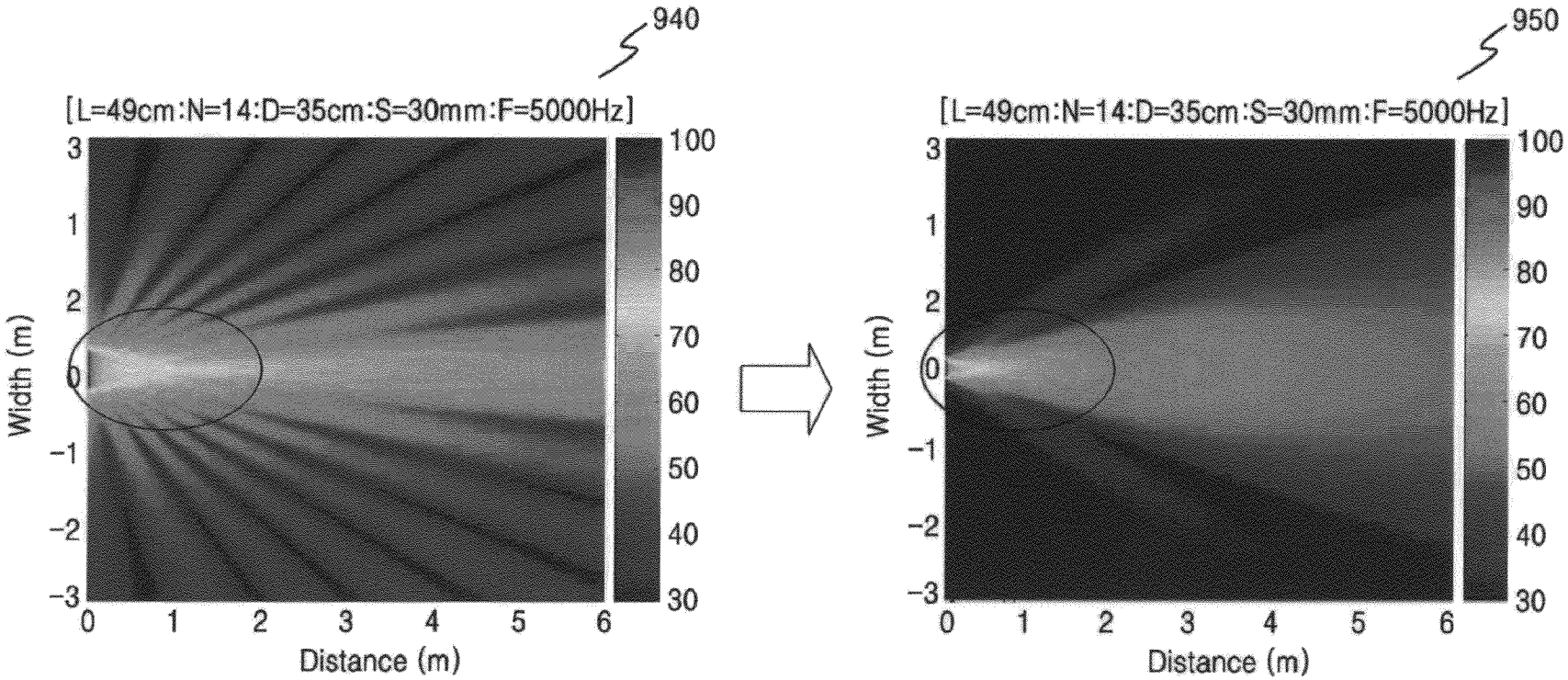

FIGS. 9A and 9B are diagrams for explaining the setting of groups using a filter corresponding to the size of an array speaker system 910 and an experimental example according to still another exemplary embodiment of the present invention, in which a listener 920 approaching an array speaker system 910 and a near-field effect region 930 are illustrated. The near-field effect region 930 is a region near the array speaker system 910 where a field that distorts sound occurs. Once the listener 920 enters the near-field effect region 930, focusing of a sound source signal cannot be done and an output signal is distorted at particular frequencies, making it difficult for the listener 920 to correctly listen to the sound source signal. For example, in order to reduce the near-field effect of a high frequency sound source signal, the near-field effect region 930 can be reduced by reducing the size of the array speaker system 910 as a distance between the array speaker system 910 and the listener 920 decreases. Thus, in the current embodiment of the present invention, the near-field effect region 930 can be controlled without degradation in focusing performance by dynamically changing the size of the array speaker system 910 that outputs a sound source signal according to the desired focusing position and the frequency of the sound source signal. In other words, as the listener 920 approaches the array speaker system 910 and the frequency of an output sound source signal increases, the near-field effect region 930 has to be reduced.

FIG. 9B illustrates an experimental example in which an emission pattern changes according to whether or not filtering is applied during the output of a high-frequency sound source signal. In FIG. 9B, an emission pattern 940 can be seen when a sound source signal is output using the entire array speaker system without using a group filter. In the emission pattern 940, intense sound distortion occurs especially in a center portion of the array speaker system as indicated by a circle. On the other hand, in an emission pattern 950, by using a group filter that is set to output the sound source signal using only the center portion of the array speaker system, little sound distortion can be seen in the center portion of the array speaker system.

Figure 10:
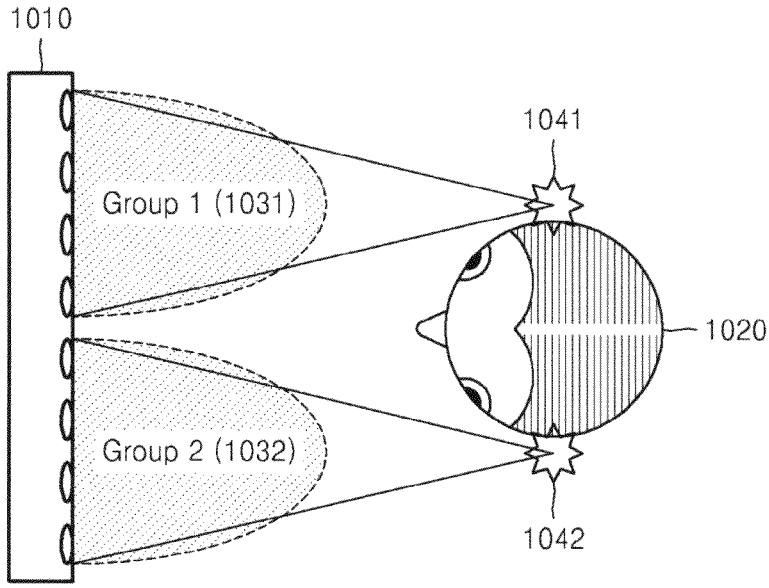
FIG. 10 is a diagram for explaining setting of groups using a filter corresponding to the number of focusing positions of an array speaker system according to still another exemplary embodiment of the present invention.

FIG. 10 is a diagram for explaining the setting of groups using a filter corresponding to the number of focusing positions of the sound source signal of an array speaker system 1010 according to still another exemplary embodiment of the present invention, in which the array 1010, a listener 1020, and 2 groups 1031 and 1032 divided by a group filter are illustrated. By dividing speakers of the array speaker system 1010 into the 2 groups 1031 and 1032 using the group filter, the two groups 1031 and 1032 can be focused to a left ear 1042 and a right ear 1041 of the listener 1020, respectively. Thus, an array speaker system can implement a stereo audio system by mapping 2 channels to the groups 1031 and 1032. The group filter can be implemented by previously checking a distance between a user and the array speaker system 1010, storing a set value in a particular storage device in order to output a stereo sound source signal through divided channels, and reading the stored set value to apply the set value to the group filter when a stereo function is required.

Figure 11:
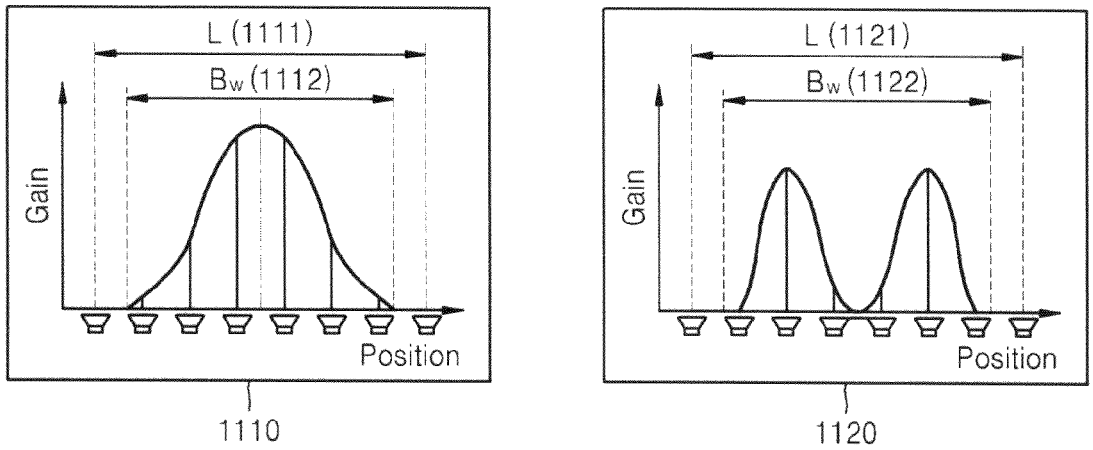
FIG. 11 shows diagrams for explaining the setting of groups using a filter corresponding to the size of an array speaker system and the number of focusing positions of the array speaker system according to still another exemplary embodiment of the present invention.

FIG. 11 is a diagram for explaining the setting of groups using a filter corresponding to the size of an array speaker system and the number of focusing positions of the array speaker system according to still another exemplary embodiment of the present invention. FIG. 11 shows how much gain a sound source signal, which has passed through a group filter, has according to the position of the array speaker system when the gain sound source signal is output.

In graph 1110 illustrated in FIG. 11, when the length of the entire array speaker system is L 1111, a sound source signal passing through a particular group filter uses only speakers within a length $B_W$ 1112 remaining after the exclusion of speakers in the outmost portion of the array speaker system, instead of using all speakers of the array speaker system. In addition, the sound source signal is output such that a gain is largest in the center portion of the array speaker system and becomes smaller towards the outmost portion of the array speaker system. Using the group filter having such a gain, a user distant from the center portion of the array speaker system can clearly listen to the sound source signal output through the array speaker system. Moreover, when an output sound source signal is a high-frequency sound source signal, the user can listen to an undistorted sound source signal even when closely approaching the array speaker system due to the reduction of the near-field effect.

When a sound source signal input into the array speaker system according to the present invention is of a multi-channel type or has a plurality of focusing positions, the speakers of the array speaker system may be divided into a plurality of groups. A graph 1120 of FIG. 11 corresponds to a group filter in which the array speaker system is divided into 2 logical groups using a gain of each channel. A high-frequency sound source signal can be output without producing the near-field effect by using $B_W$ 1122 instead of L 1121 and a 2-channel stereo effect can be obtained by dividing the array speaker system into 2 groups. Depending on purpose, channels may be completely separated, may overlap each other, or may be separated as independent groups based on the required plurality of focusing positions for a plurality of listeners. The groups may be implemented with different channels like in stereo output, or the same channel may be divided into a plurality of groups for a plurality of focusing positions. By constructing the required combination of speakers of the array speaker system using the filter, the speakers of the array speaker system can be easily set as logical groups of various forms in order to process a sound source signal.

It is a general problem that sound adjustment is difficult to perform when the wavelength of a sound source signal is greater than the size of an array speaker system, i.e., when the sound source signal is a low-frequency signal below a certain threshold frequency. In this case, most array speaker systems set a threshold frequency to a value that is greater than the size of the array speaker system. However, when the threshold frequency is set at a relatively high frequency, a low-frequency component is not reproduced well or focusing of a sound source signal fails, resulting in the sound source signal scattering in an undesired direction or to an undesired position. In particular, when the size of an array speaker system is smaller than the wavelength of a sound source signal to be output, like in a small-sized audio device, the array speaker system operates as a single sound source, degrading a focusing effect. At this time, by dividing the speakers of the array speaker system into 2 sound source groups, the same effect as when the sound source signal is emitted from 2 sound sources can be obtained, thereby improving the focusing performance.

Figure 12:
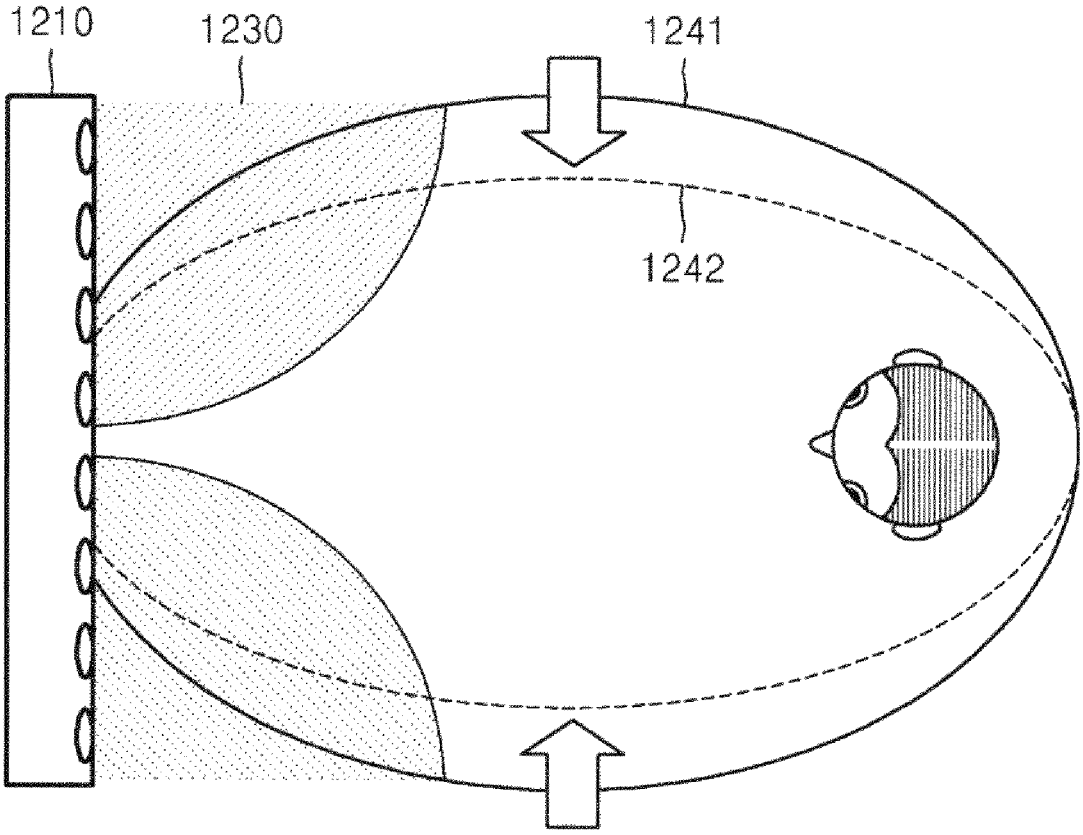
FIG. 12 is a diagram for explaining adjustment of a beam width of an output sound source signal by dividing the speakers of an array speaker system into groups using a filter according to still another exemplary embodiment of the present invention.

FIG. 12 is a diagram for explaining adjustment of a beam width of an output sound source signal achieved by dividing speakers within an array speaker system 1210 into groups using a filter according to still another exemplary embodiment of the present invention. In FIG. 12, as mentioned above, it is assumed that, due to a short distance between the array speaker system 1210 and a listener resulting from the use of a small-size audio device, focusing of the sound source signal at the listener's position is not performed well when a low-frequency signal is output. Beam widths 1241 and 1242 indicate a beam width before the filter is applied thereto and a beam width after the filter is applied thereto, respectively. Referring to FIG. 12, by dividing speakers within the array speaker system 1210 into 2 groups 1230, the beam width 1242 is reduced relative to the beam width 1241, corresponding to a low-frequency sound source signal that acts like a single sound source signal due to the filter not being applied, and thereby sound adjustment is facilitated.

As described above, according to the present invention, combinations of a plurality of speakers included in an array speaker system are set as logical groups and a last step involves sound source signals being selectively assigned to the set groups in order to adjust the sound source signals according to the sound source characteristics of the groups, thereby allowing sound adjustment and sound output that are optimized for each frequency band during broadband frequency output. Even when a listener approaches the array speaker system, the size of the array speaker system can be reduced using the set groups, thereby preventing the near-field effect that distorts output sound source signals. Moreover, by adjusting a sound source signal using groups that are set according to the number of focusing positions and the focusing positions, stereo and multi-channel effects can be obtained for small-size audio devices and the directivity of the array speaker system can be improved.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. An array speaker system comprising:

a group setting unit setting one or more combinations of a plurality of speakers included in an array speaker system into at least one group according to a predetermined adjustment factor, wherein one or more speakers among the plurality of speakers may be excluded from all of the combinations;

a signal assignment unit dividing an input signal into at least one sound source signal according to the adjustment factor and selectively assigning the divided sound source signal(s) to the set group(s);

a sound adjustment unit adjusting a sound source signal to be output through speakers within the group according to sound source characteristics of the group; and a signal output unit outputting the adjusted sound source signal through the speakers within the group.

2. The array speaker system of claim 1, wherein the predetermined adjustment factor is a value that is set in advance based on at least one of a frequency band of a sound source signal, a required emission direction of the sound source signal, a required focusing position of the sound source signal, and the required number of focusing positions of the sound source signal.

3. The array speaker system of claim 1, wherein the combinations are combinations of speakers selected based on at least one of a size of the array speaker system corresponding to a frequency wavelength and positions of the speakers in the array speaker system from among the plurality of speakers of the array speaker system.

4. The array speaker system of claim 1, wherein the signal assignment unit comprises a group filter that filters the input signal according to the adjustment factor in order to divide the input signal into the at least one sound source signal.

5. An array speaker system comprising:

a group setting unit setting one or more combinations of a plurality of speakers included in an array speaker system into at least one group according to a predetermined adjustment factor;

a signal assignment unit dividing an input signal into at least one sound source signal according to the adjustment factor and selectively assigning the divided sound source signal(s) to the set group(s);

a sound adjustment unit adjusting a sound source signal to be output through speakers within the group according to sound source characteristics of the group; and a signal output unit outputting the adjusted sound source signal through the speakers within the group, wherein the combinations are combinations of speakers from among the plurality of speakers of the array speaker system located at predetermined intervals from each other, where the predetermined intervals have lengths corresponding to a frequency wavelength.

6. The array speaker system of claim 5, wherein the predetermined intervals are each a half of the frequency wavelength.

7. A method of implementing an array speaker system, the method comprising:

setting combinations of a plurality of speakers included in an array speaker system as groups according to a predetermined adjustment factor, wherein one or more speakers among the plurality of speakers may be excluded from all of the combinations;

dividing an input signal into at least one sound source signal according to the adjustment factor and selectively assigning the divided sound source signal(s) to the set group(s);

adjusting a sound source signal to be output through speakers corresponding to the appropriate group according to sound source characteristics of the group; and outputting the adjusted sound source signal through the speakers corresponding to the appropriate group.

8. The method of claim 7, wherein the predetermined adjustment factor is a value that is set in advance based on at least one of a frequency band of a sound source signal, a required emission direction of the sound source signal, a required focusing position of the sound source signal, and the required number of focusing positions of the sound source signal.

9. The method of claim 7, wherein the combinations are combinations of speakers selected based on at least one of a size of the array speaker system corresponding to a frequency wavelength and positions of the speakers on the array speaker system from among the plurality of speakers of the array speaker system.

10. The method of claim 7, wherein the division of the input signal and the selective assignment of the divided sound source signal comprises filtering the input signal according to the adjustment factor in order to divide the input signal into the at least one sound source signal.

11. A method of implementing an array speaker system, the method comprising:

setting combinations of a plurality of speakers included in an array speaker system as groups according to a predetermined adjustment factor;

dividing an input signal into at least one sound source signal according to the adjustment factor and selectively assigning the divided sound source signal(s) to the set group(s)

adjusting a sound source signal to be output through speakers corresponding to the appropriate group according to sound source characteristics of the group; and outputting the adjusted sound source signal through the speakers corresponding to the appropriate group, wherein the combinations are combinations of speakers located at predetermined intervals having lengths corresponding to a frequency wavelength from among the plurality of speakers of the array speaker system.

12. The method of claim 11, wherein the predetermined intervals are each a half of the wavelength.

13. A computer-readable recording medium having recorded thereon a program for executing a method of implementing an array speaker system, the method comprising:

setting combinations of a plurality of speakers included in an array speaker system as groups according to a predetermined adjustment factor, wherein one or more speakers among the plurality of speakers may be excluded from all of the combinations;

dividing an input signal into at least one sound source signal according to the adjustment factor and selectively assigning the divided sound source signal(s) to the set group(s);

adjusting a sound source signal to be output through speakers corresponding to the appropriate group according to sound source characteristics of the group; and outputting the adjusted sound source signal through the speakers corresponding to the appropriate group.

* * * * *